United States Patent [19]

Wynnyckyj et al.

[11] Patent Number: 4,615,302

[45] Date of Patent: Oct. 7, 1986

[54] CONVECTION SECTION ASH MONITORING

[75] Inventors: John R. Wynnyckyj, Kitchener; Edward Rhodes, Waterloo; Robert Marr, Kitchener, all of Canada

[73] Assignee: University of Waterloo, Waterloo, Canada

[21] Appl. No.: 757,497

[22] Filed: Jul. 22, 1985

Related U.S. Application Data

[63] Continuation of Ser. No. 734,175, May 15, 1985, Pat. No. 4,552,098, which is a continuation of Ser. No. 583,573, Feb. 24, 1984, Pat. No. 4,556,019.

[51] Int. Cl.[4] ..... F28G 1/00

[52] U.S. Cl. ..... 122/379; 110/185; 122/504.2

[58] Field of Search ..... 122/379, 390, 391, 392, 122/504.2, 235 A; 110/185, 190; 165/1, 11 R, 94, 95; 73/61.2, 61.3; 374/7

[56] References Cited

U.S. PATENT DOCUMENTS 3,257,993 6/1966 Kochey, Jr. ..... 122/392
3,918,300 11/1975 Weisstuch et al. ..... 374/7 X
4,138,878 2/1979 Holmes et al. ..... 73/61.2 X
4,290,388 9/1981 Ruhe et al. ..... 122/235 A
4,408,568 10/1983 Wynnyckyj et al. ..... 122/379 X

OTHER PUBLICATIONS

Karlekar, et al., *Engineering Heat Transfer,* West Publishing Co., 1977, pp. 416–418.

*Primary Examiner*—Albert J. Makay
*Assistant Examiner*—Steven E. Warner
*Attorney, Agent, or Firm*—Sim & McBurney

[57] ABSTRACT

Fouling of the convection section of a steam generator by ash or other solid deposit from the product gas stream is monitored using radiation pyrometers which determine the temperature drop across a bank of heat exchanger tubes and calculation therefrom of a fouling factor related to the degree of fouling. Soot blowers are actuated, in manual response or automatic response, to the fouling factor, to effect cleaning of the heat exchanger tubes. Heat flux meters also may be provided to determine variations in the degree of fouling transverse to the flow of the gas stream and the determinations may be used to actuate selective cleaning of parts of the tube bank.

1 Claim, 3 Drawing Figures

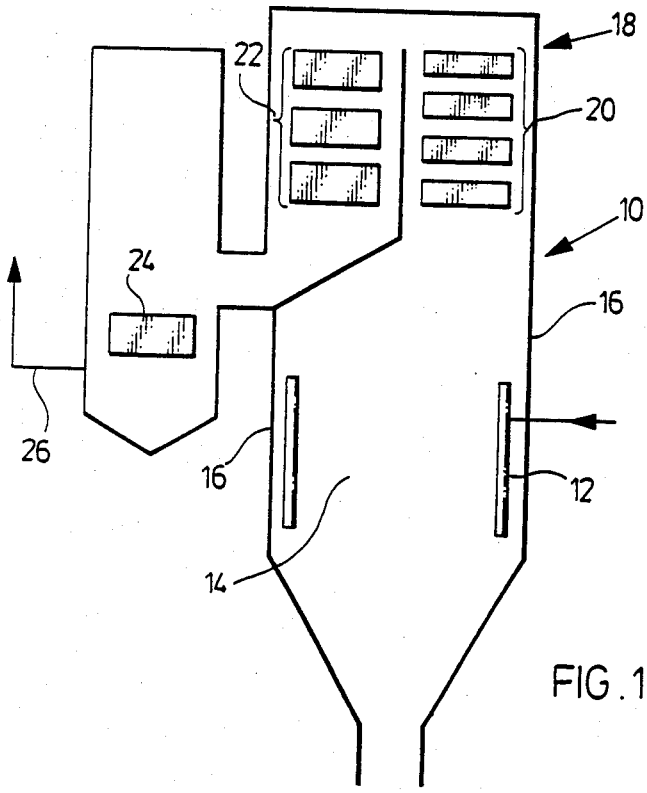
FIG. 1.
FIG. 2.
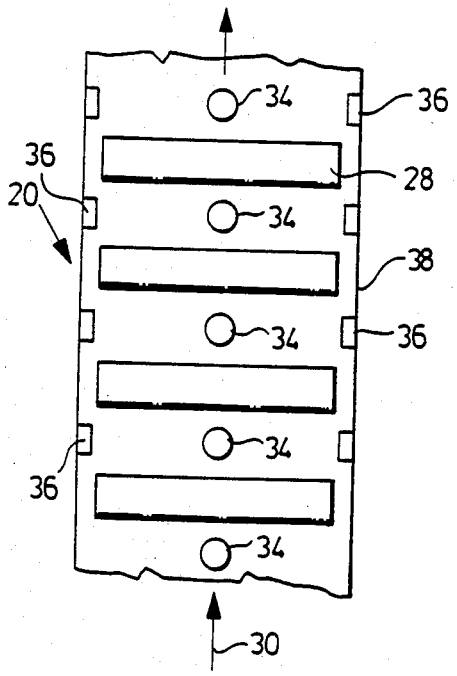
FIG. 3.
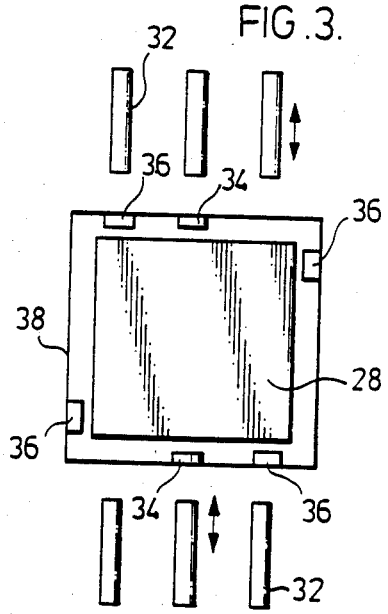

CONVECTION SECTION ASH MONITORING

This is a continuation of application Ser. No. 734,175 filed May 15, 1985 now U.S. Pat. No. 4,552,098, which itself is a continuation of application Ser. No. 583,573 filed Feb. 24, 1984 now U.S. Pat. No. 4,556,019.

FIELD OF INVENTION

The present invention relates to the monitoring and control of ash build up in the convection section of a steam generator.

BACKGROUND TO THE INVENTION

In the operation of a pulverized coal-fired boiler, a significant fraction of the ash contained in the coal is deposited on the water walls of the combustion chamber and on the heat exchange tubes of the convection section of the boiler. The ash deposits have a low thermal conductivity, modify the radiative properties of the surfaces and insulate the tubes from the flame and from the combustion gases. These effects interfere with the efficient gas-to-tube heat transfer to both the furnace walls and the convection section tubes.

In U.S. Pat. No. 4,408,568, in which two of us are named as inventors and which is assigned to the assignee hereof, there is described a method of monitoring the build up of ash on the inside walls of a coal-fired boiler by simultaneously determining the actual heat flux present in the boiler and the heat flux reaching the walls of the boiler, and determining the difference in heat flux value as a measure of the build up of ash on the inside walls. The signal indicative of the degree of furnace fouling may be used by a furnace operator as a determination for initiation of soot blower operation and/or other furnace control action, or may be utilized for automatic initiation of soot blower operation or other boiler control.

In the convection section of the steam generator, heat is removed from the combustion gas stream by convection and conduction through the walls of tubes contacted by the gas stream and through which steam flows. Usually banks of heat transfer tubes are provided which are serially contacted by the flowing gas stream. The function of the convection section usually includes superheating pressurized steam prior to passage to a turbine driven by the steam to produce power, and re-heating of low-pressure steam returned from the high-pressure side of the turbine, prior to recycle to the low-pressure side of the turbine.

As noted above, ash deposition also can occur on the tubes in the convection section of the boiler. At present, no direct means is being provided for assessing the amount of ash being deposited in the convection section and the degree to which the deposit has decreased the ability of the heat exchange surfaces to transfer the heat from the gas phase to the steam.

Ash deposition, moreover, may occur unevenly. Across one particular horizontal plane of a tube bank, there may occur more fouling in one side or corner than in another, causing an uneven distribution of gas flow, usually called channelling. In the present manner of operating steam generators, there is provided no means to identify the degree of uneveness of the fouling.

An operator relies on a number of indirect signals and the occasional visual inspection to determine when to operate soot blowers to remove accumulations of deposited ash from the tubes in the convection section.

The lack of more direct information has led to inefficiencies, upsets in control leading to non-steady operation, and occasionally catastrophic fouling necessitating shutdown. In addition, there is considerable needless or excessive soot blowing of convection section tubes which are actually clean. Soot blowing erodes the heat-exchange tubes, so that much needless soot blowing is detrimental and costly.

There are diagnostic systems being marketed which are based on measuring the conditions at the exit of the boiler. These systems permit only an indirect measure of fouling and, since response times are long, the signals are generally inadequate to achieve satisfactory control.

There is a need, therefore, to provide a direct means of measuring ash build up in the convection section of steam generators, so that boiler operation can be improved.

SUMMARY OF INVENTION

In accordance with the present invention, the temperature of a flowing hot gas stream passing over heat exchange surfaces removing heat from the gas stream at two spaced-apart locations in the flowing gas stream is directly measured. The temperature difference between the two locations is determined from these direct measurements and the temperature difference may be used as a measure of the build up of ash on heat exchange surfaces between the two locations.

The measure of the build up of the ash or the degree of fouling may be used to determine a fouling factor which, in turn, is used to effect cleaning of the heat exchange surfaces in response to predetermined values of the fouling factor, thereby to control the build up of ash on the heat exchange surfaces.

The direct determination of temperature may be effected in any convenient manner, preferably with radiation pyrometers, although clean heat flux meters sighting through openings in the wall confining the hot gas stream may be used.

GENERAL DESCRIPTION OF INVENTION

In one embodiment of the present invention, there is provided a method of determining the amount and distribution of ash build up in the convection section of a steam generator by using a combination of radiation pyrometers or suitable substitutes and heat flux meters or suitable substitutes. The radiation pyrometers or suitable substitutes measure the difference in gas temperatures across a bank of heat exchanger tubes in the convection section while the heat flux meters or suitable substitutes monitor the channelling of the gases caused by uneven ash buildup.

The radiation pyrometer is focussed on the gas space between tube banks. The reading of the pyrometer is corrected for changes in the emissivity of the gas stream caused by varying concentrations of water vapour, carbon dioxide and coal ash particulates in the gas stream. The corrections are conveniently calculated continuously and on-line, using a dedicated mini- or micro-computer, which monitors the pyrometer reading as well as the coal and air throughput rates and ash contents. By using two pyrometers, located across one tube bank, the decrease in the gas temperature in the bank is measured. The steam flow rate and its temperature drop across the same tube bank, which routinely are measured in the operation of modern steam generators, also are fed to the computer. Using the latter information together with the gas temperature drop determined by the pyrometers, the computer continuously calculates a fouling factor ($R_F$), as described in more detail below. The fouling factor is uniquely proportional to the degree of fouling of the tube bank, and its value may be displayed, either numerically or visually, such as, in the form of a colour-coded diagram, on a monitor screen. The value also may be recorded on any convenient medium.

As noted previously, uneven fouling causes the flow of the combustion gases to channel in the tube banks. In the preferred embodiment of the invention, heat flux meters are located in critical positions on the water tube walls enclosing the convection section. In some instances, fouling in this area may be a problem and a suitable alternative to the heat flux meters located on water tube walls is to provide clean flux meters sighted through openings. In other cases, it may be convenient to use thermocouples protruding into the gas stream.

When the heat flux monitored by one of these meters reads significantly lower and/or higher than the average for a particular level in the bank, this indicates an unevenly-fouled tube bank and this information also may be displayed, either numerically or visually, on a monitor screen, and, if desired, recorded on any convenient medium.

The steam generator operator uses the fouling factor and gas channelling information to determine periodic and selective operation of soot blowers to remove accumulations of ash from selected convection section banks, for optimum operating results and minimum tube erosion. Alternatively, the signals may be used to effect automatic actuation of soot blowers when a particular $R_F$ value is recorded for a particular bank of heat-exchange tubes. The channelling signal may be used to override the command or to actuate selective soot blower operation and thereby prevent needless blowing and the resulting tube erosion and steam loss.

BRIEF DESCRIPTION OF DRAWINGS

FIG. 1 is a schematic representation of a typical coal-fired steam generator to which the present invention is directed;

FIG. 2 is an elevational view of a bank of convection section heat exchanger tubes modified in accordance with a preferred embodiment of the invention; and FIG. 3 is a plan view of the bank of convection section heat exchange tubes of FIG. 2.

DESCRIPTION OF PREFERRED EMBODIMENT

Referring to the drawings, FIG. 1 illustrates schematically a coal-fired boiler 10. Pulverized coal and air are fed through burners 12 into the firing chamber 14 of the boiler 10. As is well known, the furnace walls 16 are comprised of a plurality of parallel tubes wherein steam is generated for feed to a steam collection system (not shown).

Combustion gases pass upwardly into the convection section 18 of the boiler 10. The convection section 18 contains banks 20 and 22 of heat exchange tubes through which steam is passed to effect superheating and reheating in known manner. The combustion gases next pass over an economizer 24 and an air heater (not shown) before being exhausted to atmosphere by line 26.

During operation of the boiler 10, ash and slag deposit on the furnace walls 16 and also on heat exchanger banks 20 and 22, sticking to the tubes and decreasing heat absorption across those surfaces and otherwise causing operating difficulties. Soot blowers (not shown in FIG. 1) are located throughout the boiler 10 for actuation to remove accumulations of deposits from heat exchanger tube surfaces, by directing jets of steam against the accumulations.

As noted previously, in U.S. Pat. No. 4,408,568, there is described a method of monitoring the build up of ash and other deposits on the furnace walls 16 by utilizing a plurality of flux meters located in the walls 16 directly facing the flame.

The present invention is concerned with monitoring of the build up of deposits on the heat exchanger tubes forming the banks 20, 22 and 24 and specific reference now is made to FIGS. 2 and 3, which are schematic elevational and plan views of a bank 20 of heat exchange tubes.

The structure of the individual banks 28 of heat exchange tubes is entirely conventional and includes a series of tubes which carry steam therethrough and which remove heat from the flowing gas stream 30 through the tube walls to heat the flowing steam. Horizontally-disposed, retractable soot blowers 32 are associated with the individual banks 28 to effect removal of accumulation of deposits from the tube surfaces.

In accordance with this invention, radiation pyrometers 34 are provided at both the upper and lower end of the bank 20 of heat exchanger tubes and also between vertically-adjacent pairs. It is possible to provide a pair of pyrometers 34 for a complete bank of convection section tubes 20 or 22 (or indeed for the economizer 24) or to provide a pair of pyrometers 34 with one individual bank 28 of heat exchange tubes or selected individual banks, depending on the demand of a local situation. Each pyrometer 34 measures the temperature of the gas stream 30 at its location. The pyrometers 34 are focussed on the gas stream, usually at the longitudinal centre line of the bank 20 or 22.

The pyrometers 34 may be of the type which is sensitive to the wavelength range where carbon dioxide and water absorb and emit radiation. To convert the pyrometer signal to a true temperature determination, a correction for the inherent emissivity of the gas space is needed. Emissivity is affected by the percent water, percent carbon dioxide, percent ash in the coal, total air flow, and gas temperature. The correction is accomplished by calculation from the gas phase composition. Alternatively, the pyrometers 34 may be of the type which is sensitive to the wavelength range where carbon dioxide and water do not emit and/or absorb radiation. In this case, the signal is usually due to the solid paricles in the gas stream and the temperature determination usually is corrected using data for total air flow, percent ash in the coal and feed rate of coal. Usually, the correcting calculations are effected on line by a dedicated computer. Both types of pyrometer may be used, if desired, depending on individual cases, as may pyrometers which are not sensitive to any particular wavelength, but measure total radiation. In still other specific cases, a clean heat flux meter, such as one of the type described in U.S. Pat. No. 4,408,568, the disclosure of which is incorporated herein by reference, may be used. Suitable corrections to the signals are still applied.

The pyrometers 34 measure the vertical temperature drop across the bank 28 of heat exchange tubes along the approximate centre line of the bank. As fouling of the individual tubes in the bank 28 occurs, less heat is transferred across the tube surfaces to heat the steam, resulting in a lesser temperature drop between each pair of pyrometers 34. The determined temperature difference preferably is fed to an on-line computer to which also is fed determinations of steam temperature and flow, and data for correction of the pyrometer readings, as noted above.

The relationship which exists in the heat exchanger bank is provided by equation (1):

$$Q = UA\Delta T_{1m} \quad (1)$$

where Q is the heat absorbed by the steam and is determined from measurements of temperature and flow rate on the steam side of the tubes, $\Delta T_{1m}$ is the log mean temperature drop across the bank as determined by the radiation pyrometers and thermocouples in the steam lines, A is the area of the surface of the tubes and U is the effective heat transfer coefficient of the tubes, part of which is contributed by fouling.

The fouling factor ($R_F$) may then be determined from the equation (2):

$$\frac{1}{U} = \frac{1}{(h_c)_f} + \frac{1}{(h_c)_s} + \frac{L}{k} + R_F \quad (2)$$

where U is the effective heat transfer coefficient determined from equation (1), $R_F$ is the fouling factor, $(h_c)_f$ is the convective heat transfer coefficient on the gas stream side of the tubes, $(h_c)_s$ is the convective heat transfer coefficient on the steam side of the tubes, and L and k respectively are the thickness and thermal conductivity of the convection section tubes.

The calculations required to be effected using equations (1) and (2) are most effectively done by a computer programmed to receive measured temperatures and flow rates and to calculate U and thence $R_F$. The fouling factor ($R_F$) may be provided to the operator as a numerical value or may be displayed on a monitor screen as a part of a graphic representation of the fouling of the convection section, which may be colour-keyed to indicate differing degrees of fouling, to assist the operator in controlling the combustion process.

When the fouling reaches a predetermined level for any particular bank 28, the soot blowers 32 for what bank are actuated, either as a result of operator intervention or by automatic computer-operated actuation, to remove accumulations of deposits from the surfaces of the heat exchange tubes in that bank.

In a preferred embodiment of the invention, provision is made to override actuation of certain soot blowers 32 in response to a determination of channelling. As previously noted, channelling of gases may occur in the bank 28 of heat exchange tubes as a result of different degrees of fouling in the horizontal plane. Heat flux meters 36 are located on the water tube walls 38 of the convection section 18 in the horizontal plane. Horizontally planarly-aligned sets of four or more of such heat flux meters 36 may be provided at longitudinally-spaced locations in the banks 20 and 22.

The heat flux meters 36 each measure the heat flux reaching that meter. The heat flux meters 36 may be of any convenient construction, for example, that described in copending U.S. patent application Ser. No. 557,327 filed Dec. 2, 1983 and entitled "Heat Flux Meter", assigned to the assignee herein, the disclosure of which is incorporated herein by reference. The flux meters may be affixed to the wall tubes and be the fouling or dirty type. Alternatively, should fouling of the walls occur, the clean heat flux meters of the type described above sighted through openings in the walls, may be used. In still other specific cases, it may be advantageous to use thermocouples whose protection walls protrude into the gas stream.

The heat flux reaching each meter 36 is determined by the flow of gas 30 through the particular heat exchanger tube bank 28. In the absence of channelling, the heat flux reaching each meter 36 is substantially the same. However, if fouling occurs preferentially in a certain area of the horizontal extremity of the heat exchanger tube bank 28, then the gas flow is channelled into the remainder of the tube bank 28 and is greater than in the preferentially-fouled area. Under these circumstances, the heat flux reaching the flux meters 36 differs. The radiation pyrometer 34 does not necessarily detect these variations, since the temperature determination made thereby is with respect to gas flow through the generally central region of the tube bank 28. The flux meters 36, therefore, are used to monitor the degree of channelling and the heat flux determinations effected thereby preferably are used to actuate, either manually or in automatic computer-controlled manner, selected ones of the soot blowers 32 to effect selective cleaning of the heat exchange tubes in the zone preferentially fouled. Such selected soot blower operation, therefore, prevents actuation of all the soot blowers 32 in response to a fouling condition detected by the radiation pyrometers 34. Only those areas requiring cleaning are actually exposed to soot blowing. In this way, tube erosion, a considerable cost and operating problem, is minimized and steam savings maximized.

Fouling of the convection section 18 of the boiler 10 by solid deposits from the gas stream 30, therefore, is monitored by radiation pyrometers 34 and by heat flux meters 36. The measurements effected by these instruments are processed to generate operator information with respect to the condition of the convection section or may be employed in computer-controlled automatic actuation of the tube cleaning operations, using soot blowers, in response to a predetermined set of conditions indicated by the measurements.

Direct measurement of the temperature of the gas stream is effected using the radiation pyrometers and this measurement is used for accurate instantaneous determination of the build up of ash and other solid deposits in the convection section. By compensating for the emissive properties of the gas stream and also by taking into account the effects of channelling, a boiler operator, for the first time, is provided with information which enables precise boiler operation to be effected. Alternatively, automatic precise cleaning of the convection section may be effected using computer control based on the collected data. In this way, the problems of the prior art with respect to the fouling of the convection section and steam tube erosion in steam generators are overcome.

SUMMARY OF DISCLOSURE

In summary of this disclosure, the present invention provides a convection section ash monitoring and control system which enables the fouling of heat exchanger tubes to be precisely monitored and controlled. Modifications are possible within the scope of this invention.

What we claim is:

1. A method of controlling the build-up of ash on heat exchange surfaces of a convection section of a steam generator having a furnace section wherein fuel is combusted to form a flowing hot gas stream which flows out of said furnace section into and through the convection section of said steam generator wherein said heat exchange surfaces comprise a plurality of banks of heat exchange tubes located transverse to the direction of gas flow through the convection section so as to contact the hot gas stream and having steam of temperature lower than that of the hot combustion products gas stream passing therethrough to be heated by heat exchange between the hot gas stream and the heat exchange tubes, which comprises:

determining a fouling factor ($R_F$) for each bank of heat exchange tubes as a measure of the degree of fouling of each of the banks of heat exchange tubes from the difference in temperature of the hot gas stream flowing over and in contact with each bank between the upstream and downstream side of each bank, said difference in temperature being determined by directly measuring the temperature of the gas stream at each upstream and downstream location and calculating the temperature difference therefrom, and selectively actuating cleaning of a bank of said heat exchange tubes in said convection section in response to predetermined values of the fouling factor for the selected bank.

* * * * *